United States Patent [19]

Cousino

[11] Patent Number: 4,578,188

[45] Date of Patent: Mar. 25, 1986

[54] SEWERAGE FLOW DIVERTER

[76] Inventor: Kenneth P. Cousino, 2860 Grant, Ann Arbor, Mich. 48104

[21] Appl. No.: 759,595

[22] Filed: Jul. 26, 1985

[51] Int. Cl.[4] ..... E03F 3/04

[52] U.S. Cl. ..... 210/170; 210/532.1; 137/561 A

[58] Field of Search ..... 210/170, 519, 532.2, 210/747, 521, 919–921, 801, 513, 532.1; 137/561 A, 874

[56] References Cited

U.S. PATENT DOCUMENTS

| | | | |
|---|---|---|---|
| 236,740 | 1/1881 | Waring, Jr. | 137/874 |
| 1,035,926 | 8/1912 | Wagner | 137/874 |
| 2,164,011 | 6/1939 | Hilborn | 137/561 A |
| 3,175,578 | 3/1965 | Patterson et al. | 137/561 A |
| 4,363,731 | 12/1982 | Filippi | 210/532.1 |
| 4,455,231 | 6/1984 | Filippi | 137/561 A |

FOREIGN PATENT DOCUMENTS

| | | | |
|---|---|---|---|
| 2809624 | 9/1979 | Fed. Rep. of Germany | 210/170 |
| 2927894 | 1/1981 | Fed. Rep. of Germany | 210/170 |
| 591082 | 4/1959 | Italy | 137/561 A |
| 987012 | 1/1983 | U.S.S.R. | 137/561 A |

*Primary Examiner*—Benoit Castel

*Attorney, Agent, or Firm*—James M. Deimen

[57] ABSTRACT

A sewerage flow diverter to direct relatively low volumetric liquid flow of sewerage from a large combined storm water and sewage drain to a sanitary interceptor and to direct relative high volumetric liquid flow of combined storm water and sewerage to bypass the connection to the sanitary interceptor. The diverter comprises a hollow weir positioned in the bottom of the large combined storm water and sewerage drain having a small inlet pipe from the large drain and an outlet pipe to the large drain. An opening or orifice in the hollow weir opens downwardly to an interconnect pipe to the sanitary interceptor. At low flow rates the liquid is primarily sewerage in the bottom of the large drain which possesses relatively low kinetic energy as it enters the inlet pipe in the weir. Within the weir the liquid drops through the opening and passes on to the sanitary interceptor. With increasing volumetric liquid flow in the large combined storm water and sewerage drain, the kinetic energy of the liquid entering the inlet pipe increases thereby causing increasing amounts of liquid to "leap" across the opening and pass through the outlet pipe back into the large drain. The diverter contains no moving parts and can be constructed as a single cast concrete unit for convenient installation. Existing underground mechanically operated diverters can be easily rebuilt to eliminate the mechanical gates and valves and substitute a form of the new diverter.

8 Claims, 7 Drawing Figures

SEWERAGE FLOW DIVERTER

BACKGROUND OF THE INVENTION

The invention pertains to the field of sewers, storm water drains and sewage treatment. In particular, the invention pertains to means for directing normal sewage flow in large combined storm water and sewerage drains into sanitary interceptor sewers and for causing large storm water flow to bypass the interceptor connection thereby protecting the sewage treatment facility from sudden storm water surges.

U.S. Pat. No. 3,604,728 discloses a drip irrigation device to permit a small portion of the water flow to be tapped off for leakage into the surrounding soil. The device can be formed integral with the lengths of irrigation pipe, however, there is no suggestion that low flow rates be tapped and high flow rates in the pipe not be tapped.

U.S. Pat. No. Re. 29,996 discloses a combined aerobic and anaerobic sewage treatment tank having an entrance trough leading to a weir with a hollow vertical channel. Here again there is no suggestion that low flow rates of liquid be diverted from the vertically hollow channel and high flow rates be not diverted.

Currently used diverters for directing sewerage flow from a combined storm water and sewage drain to an interceptor comprise a large concrete structure adjacent the storm drain and a connection from the concrete structure to the interceptor. The storm drain contains a diversion weir and an outlet pipe leading to the concrete structure. Controlling flow of sewage into the concrete structure is a mechanical gate which regulates the flow by a float and chain mechanism. The float, chain and gate are typically of metal and subject to failure from corrosion, metal fatigue, clogging and jamming. As a result the current diverters are expensive to manufacture, install, and maintain. Because the storm and sewage drains for a medium size city may require fifty or more diverters, installation and maintenance are significant budget items.

Tipping plate regulators have also been used to limit storm water flow from entering sanitary interceptors, however, the mechanical parts are also in contact with raw sewage and therefore subject to high maintenance cost. Small amounts of sludge or small increases in friction cause the tipping plates to cease to function.

Hydro-brake regulators comprise a set of vanes that impart high resistance to large flows entering the interconnect to the sanitary interceptor while permitting low flows to pass through almost unimpeded. The hydro-brake regulators, however, permit flows greater than peak sanitary flows.

With a view toward substantially reducing diverter maintenance and installation costs, applicant has invented the new diverter disclosed in the following description.

SUMMARY OF THE INVENTION

The invention comprises a sewerage flow diverter to direct relatively low volumetric liquid flow and heavier constituents of sewerage from a large combined storm water and sewage drain, conduit or pipe into a sanitary interceptor and to direct relatively high volumetric liquid flow of combined storm water and sewerage to bypass the connection to the sanitary interceptor. The diverter comprises a hollow weir positioned in the bottom of the large storm water and sewage drain having a small inlet pipe from the large drain and an outlet pipe back to the large drain.

An open space between the inlet and outlet pipes allows the flow to fall downwardly from inside the hollow weir to an interconnect pipe leading to the sanitary interceptor. At low flow rates the liquid is primarily sewerage in the bottom of the large drain which possesses relatively low kinetic energy as it enters the inlet pipe in the weir. Within the weir the liquid drops through the opening and passes on to the sanitary interceptor. With increasing volumetric liquid flow in the large drain, the kinetic energy of the liquid entering the inlet pipe increases thereby causing increasing amounts of liquid to "leap" across the opening and pass through the outlet pipe back into the large drain.

The diverter contains no moving parts and can be constructed as a single cast concrete unit for convenient installation. Existing underground mechanically operated diverters can be easily rebuilt to eliminate the mechanical gates and valves and a form of the new diverter substituted.

Economically the new diverters are expected to cost less than 10% of the float and gate regulator diverters for both installation and yearly maintenance.

DESCRIPTION OF THE PREFERRED EMBODIMENTS

Figure 1:
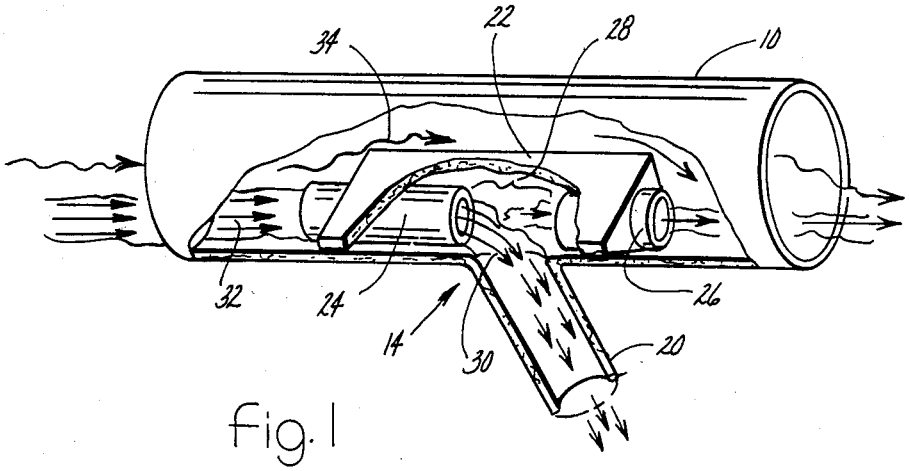
FIG. 1 is a broken away perspective view of the new flow diverter.
Figure 3:
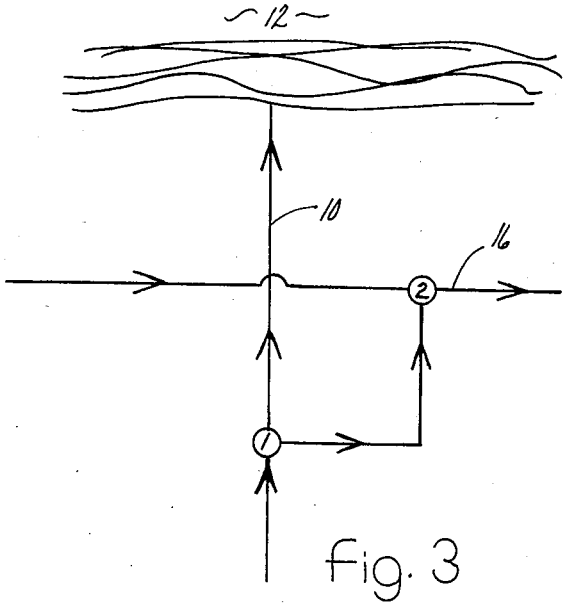
FIG. 3 is a schematic view of the combined storm run off and sewage line connected by the diverter to the treatment plant sewage collector.

Illustrated in FIG. 1 is a section of a relatively large combined storm water run off and sanitary sewer drain 10 typical of many older communities. These pipes generally are large, typically 24 inches or more in diameter and empty directly into a river or stream 12 as shown in FIG. 3. The combined storm water run off and sanitary sewer are sized for a sudden influx of storm water or spring run off greatly in excess of the treatment capacity of an economically practical sewage treatment facility. Such a facility is equipped to accommodate the normal continuous flow of sewage absent the storm water run off.

Figure 4:
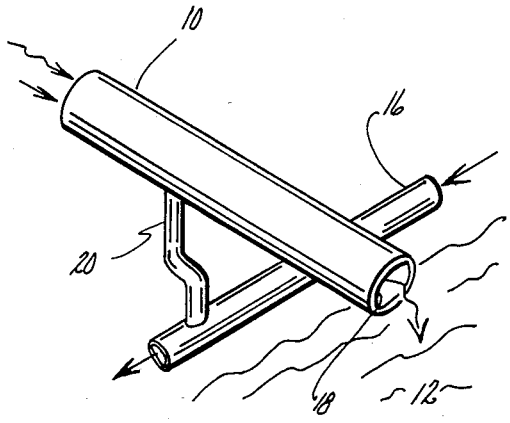
FIG. 4 is a simplified perspective view of the piping illustrated in FIG. 3.

The normal sewage flow in the combined drain 10 comprises a small fraction of the drain 10 capacity and is capable of diversion from the combined drain 10 through a diverter 14 to a secondary sewage pipe or sanitary interceptor 16 which leads to the sewage treatment plant. FIGS. 3 and 4 illustrate the schematic flow paths and the external appearance of the interconnection of the pipes in simplified form. The drain 10 leads to the river or stream 12 with an outfall at 18. The diverter given by circl 1 in FIG. 3 diverts flow from the drain 10 into a cross connect pipe 20 in turn connected at circle 2 to the secondary sewage pipe 16.

Within the drain 10 along the bottom thereof is a weir 22 having a pair of small inlet and outlet pipes 24 and 26 substantially coaxial in orientation and separated by an opening or space 28 inside the weir 22. Providing a second exit downwardly from the space 28 is a second opening 30 leading to the cross connect pipe 20. At typical sewage flow rates without storm water run off, the bulk of the liquid 32 flowing down the drain 10 enters inlet pipe 24 with only a small amount of flow, if any 34, passing over the weir 22. Because the low liquid flow rate possesses relatively low kinetic energy, the liquid entering inlet 24 follows a generally parabolic curve downward through the opening 30 to the cross connect pipe 20.

As illustrated and described below, FIGS. 1A and 1B graphically show the effect of increased levels of liquid flow in drain 10 as a result of increasing storm water run off.

Figure 2:
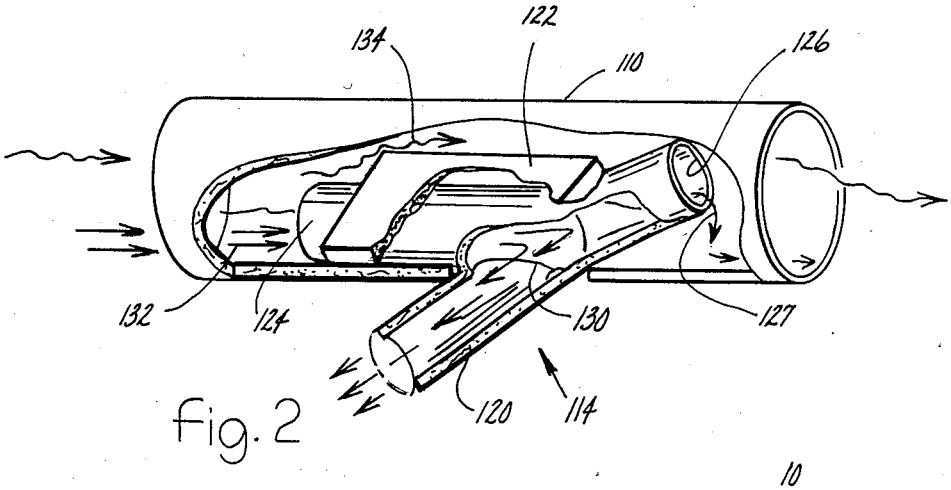
FIG. 2 is a broken away perspective view of an alternative form of the new flow diverter.

FIG. 2 illustrates an alternate form of the new diverter 114 located in the combined storm water run off and sanitary sewer drain 110. The internal weir 122 covers a wye ("Y") shaped diverter pipe 114 having an inlet 124, an outlet 126 and an entrance or opening 130 leading into a downward cross connect pipe 120. The bulk of the low liquid flow rate 132 passes into the inlet 124 and drops downwardly through the orifice 130 into the cross connect pipe 120 because of the lack of sufficient kinetic energy to carry little, if any, of the flow upwardly out of the outlet 126 as shown by the arrow 127. As with the new diverter 14 of FIG. 1, little, if any, flow passes over the weir at 134.

Figure 1A:
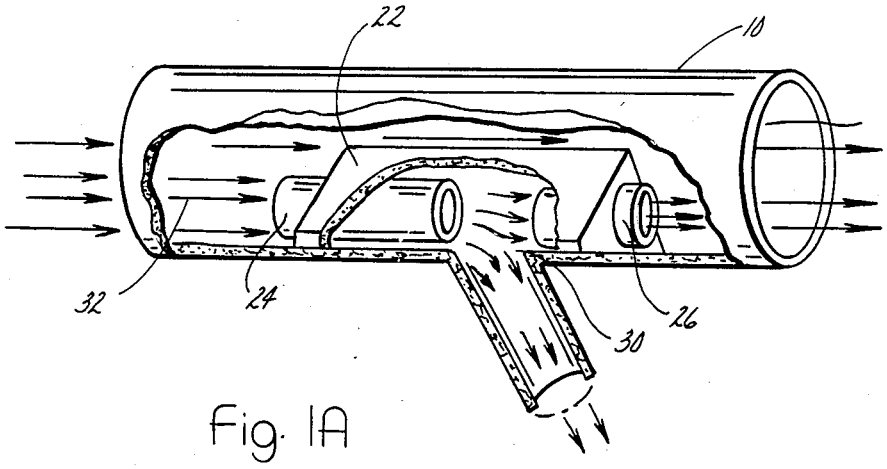
FIGS. 1A and 1B are broken away perspective views of the new flow diverter with increasing levels of storm water flow.

In FIG. 1A the flow of liquid in the drain 10 includes a substantial amount of storm water combined with sewage and completely inundates the weir 22. The liquid moves with increased velocity and therefore increased kinetic energy. The portion of the liquid flow 32 entering the inlet 24 possesses increased kinetic energy and therefore tends to fall along a shallower parabolic curve. Only a portion of the inlet flow is intercepted by the opening 30 with the balance jumping or leaping the opening 30 and passing on into outlet 26 and back into drain 10. Solids entrained in the flow tend to settle toward the bottom of the drain 10 and therefore tend to be intercepted by the inlet 24 and the opening 30.

Figure 1B:
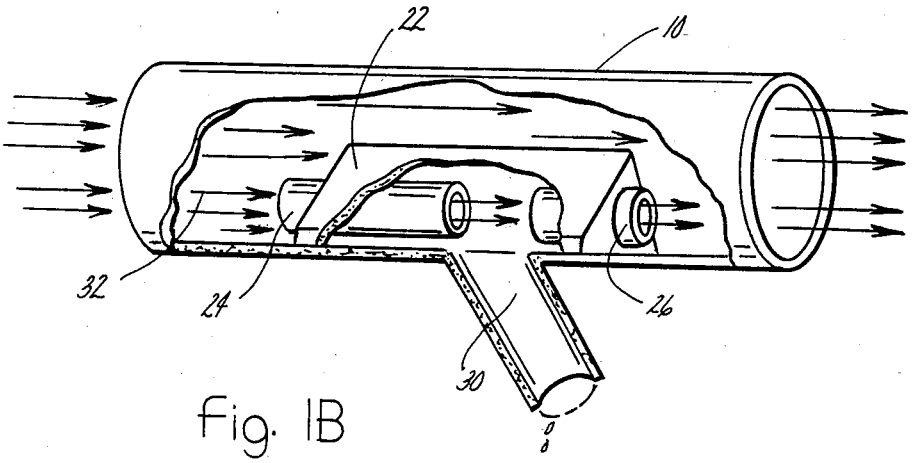

In FIG. 1B the flow of liquid in the drain 10 is almost entirely storm water with only a small portion sewage. The weir 22 is completely submerged and the liquid flow moves with high velocity and high kinetic energy. The portion of the liquid flow 32 entering the inlet 24 possesses sufficient kinetic energy to leap the opening 30 with little of the flow intercepted by the opening 30 and directed to the sanitary interceptor 16. The bulk of the flow passes on into outlet 26 and back into drain 10. In summary the volumetric flow of combined storm and sewer liquid flow automatically determines the portion of the flow intercepted by the opening 30 and directed to the sanitary interceptor 16.

The actual sizes of the inlet 24, outlet 26 and opening 30 are determined by the liquid flow rates to be expected, the size and position of the opening being selectd as a function of the falling parabolic curves calculated for each expected velocity and kinetic energy of the liquid passing into the inlet 24.

The principles of operation and configuration for the new diverter or "leaping orifice" are not limited to the particular configuration above but rather can be substantially modified. In particular, existing underground structures can be modified to incorporate the new diverter by installation of new piping and internal weirs.

Figure 5:
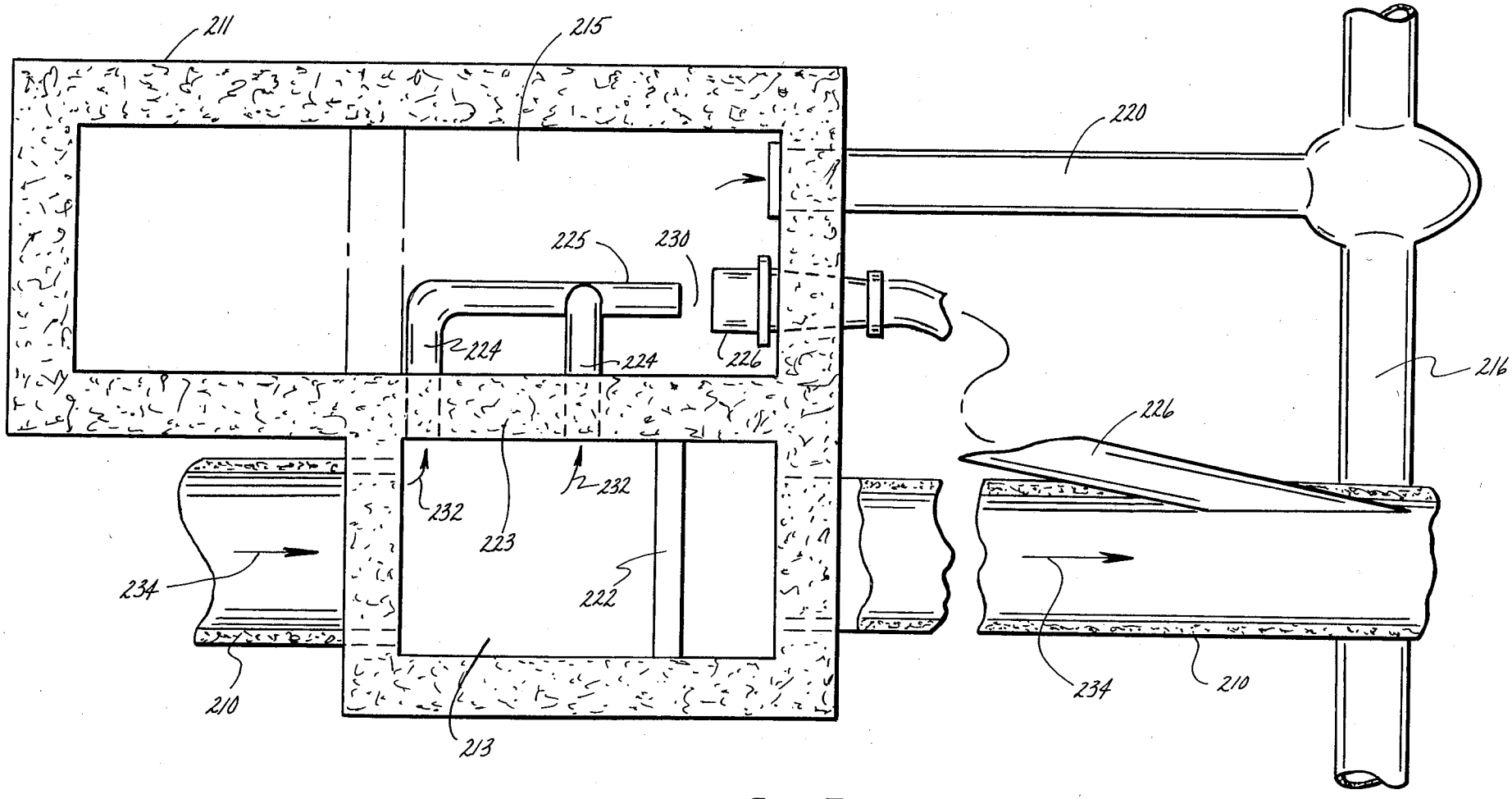
FIG. 5 is a plan view of an existing installation modified to utilize applicant's new diverter.

Illustrated in FIG. 5 is an underground concrete structure 211 divided into two chambers 213 and 215. The combined storm water and sewerage drain 210 communicates with chamber 213 flowing in the direction given by arrows 234. Separating chambers 213 and 215 is a concrete bulkhead 223 penetrated by a pair of inlet pipes 224 leading to a single pipe 225. The inlets 224 are adjacent the bottom of the chamber 213 with the inflow indicated by arrows 232. A low weir 222 extends across chamber 213 to provide that low flows of predominately sewage are directed into inlets 224.

Within chamber 215 is an outlet pipe 226 which may be of larger diameter than pipe 225 and separated therefrom by a gap or opening 230. Communicating with chamber 215 is an interconnect pipe 220 leading to a sanitary intercepter 216 which carries flow toward the wastewater treatment plant. Outlet 226 leads to the downstream portion of drain 210 as shown.

At low flows of predominately sewage the flow at low velocity enters the gap 230 and drops parabolically into chamber 215. The sewage flow then passes through interconnect pipe 220 to sanitary interceptor 216. With increasing flows of storm water in drain 210, the flow in pipe 225 increases in velocity and leaps the gap 230 to exit 226 for return to drain 210. The larger portion of the flow in drain 210 passes over the weir 222 directly into the downstream portion of drain 210.

I claim:

1. A sewage flow diverter comprising a relatively large drain, a weir in the bottom of the drain, an inlet communicating with the drain adjacent the bottom thereof, and upstream of the weir, an outlet communicating with the drain downstream from the weir, the opposite ends of the inelt and outlet being adjacent, opening means located between the opposite ends of the inlet and outlet, said opening means so located and sized to permit relatively low flows of liquid in the inlet to pass through the opening and relatively high flows to be propelled by the kinetic energy of the flow from the inlet into the outlet, and means to conduct the flow passing through the opening means to a sanitary interceptor.

2. The diverter of claim 1 wherein the inlet and outlet are axially aligned adjacent the opening means and the outlet is larger than the inlet.

3. The diverter of claim 1 wherein the weir includes a hollow portion therein, the inlet and outlet each communicate with the hollow portion therein and the opening means provides an exit from the hollow portion adjacent the opposed ends of the inlet and outlet.

4. The diverter of claim 1 wherein the inlet and outlet are joined within the weir at the opening means, the opening means providing a downwardly exit from the juncture of the inlet and outlet.

5. The diverter of claim 1 wherein the means to conduct the flow passing through the opening means comprises an interconnect pipe communicating with the sanitary interceptor.

6. A sewage flow diverter comprising a storm water and sewage drain, a weir located in the bottom of the drain and having a hollow portion within the weir, an inlet pipe extending into the weir and providing fluid communication between the drain and the hollow portion, and inlet pipe substantially aligned with the direction of liquid flow in the drain, an outlet pipe extending through the weir and providing fluid communication between the hollow portion and the drain downstream of the weir, and an interconnect pipe extending downwardly from the hollow portion, said interconnect pipe in fluid communication with the hollow portion through an opening, said inlet pipe sized in relation to the drain to provide relatively low kinetic energy to the liquid flowing therethrough at low liquid flow rates in the drain, such that the liquid will substantially drop through the opening into the interconnect pipe and at high liquid flow rates in the drain, said inlet pipe sized to provide sufficiently high kinetic energy to the liquid flowing therethrough to cause substantially all liquid flowing through the inlet pipe to pass over the opening and flow out through the outlet pipe.

7. The liquid flow diverter of claim 6 wherein the inlet pipe and outlet pipe are substantially coaxial and aligned with the direction of flow in the conduit.

8. A sewage flow diverter comprising a combined storm water and sewage drain, a hollow weir located in the bottom of the drain, an inlet pipe extending into the weir adjacent the bottomm of the drain and an outlet pipe communicating with the inlet pipe and extending from the weir, an opening from the juncture of the inlet and outlet pipes and downwardly from the weir, and an interconnect pipe communicating with the opening to provide a conduit to a sanitary interceptor, said inlet pipe sized in relation to the drain to provide relatively low kinetic energy to the liquid flowing therethrough at low liquid flow rates in the drain causing the liquid to substantially fall through the opening and to provide relatively high kinetic energy to the liquid flowing therethrough at high liquid flow rates in the drain causing the liquid to substantially pass over the opening and enter the outlet pipe.

* * * * *